US007322220B2

(12) United States Patent
Park et al.

(10) Patent No.: US 7,322,220 B2
(45) Date of Patent: Jan. 29, 2008

(54) APPARATUS FOR MANUFACTURING TRAPEZOIDAL WIRE USING TWO-SET SHAPING ROLLERS

(75) Inventors: Ki-hong Park, Gyeonggi-do (KR); Seon-tae Kim, Seoul (KR); Sang-jun Bae, Gyeonggi-do (KR); Tae-jung Lee, Gyeonggi-do (KR)

(73) Assignee: LS Cable Ltd., Seoul (KR)

( * ) Notice: Subject to any disclaimer, the term of this patent is extended or adjusted under 35 U.S.C. 154(b) by 0 days.

(21) Appl. No.: 11/645,765

(22) Filed: Dec. 27, 2006

(65) Prior Publication Data

US 2007/0180883 A1 Aug. 9, 2007

(30) Foreign Application Priority Data

Feb. 3, 2006 (KR) ..... 10-2006-0010570

(51) Int. Cl.
*B21B 13/08* (2006.01)
*D02G 3/36* (2006.01)
*D07B 1/16* (2006.01)

(52) U.S. Cl. ..... 72/234; 72/226; 57/9; 57/215

(58) Field of Classification Search ..... 57/9, 57/215, 58.52; 72/234, 226, 235; 140/149
See application file for complete search history.

(56) References Cited

U.S. PATENT DOCUMENTS 2,156,652 A * 5/1939 Harris ..... 57/215
4,173,235 A * 11/1979 Tipper ..... 140/82
4,212,151 A * 7/1980 Schauffelle et al. ..... 57/9
4,471,527 A * 9/1984 Nishijima ..... 29/872
4,599,853 A * 7/1986 Varga-Papp ..... 57/9
4,843,696 A * 7/1989 Gentry et al. ..... 29/33 F
5,074,140 A 12/1991 Sanders
6,840,031 B2 * 1/2005 Blackmore et al. ..... 57/58.52

* cited by examiner

*Primary Examiner*—Dmitry Suhol
(74) *Attorney, Agent, or Firm*—McDermott Will & Emery LLP

(57) ABSTRACT

An apparatus for manufacturing a trapezoidal wire using two-set shaping rollers has a body rotating about a central axis at a predetermined speed, a plurality of first shaping roller sets installed along an outer circumference of the body, each first shaping roller set including an upper roller and a lower roller and a shaping portion, into which a wire is inserted to be processed, between the upper roller and the lower roller, and a plurality of second shaping roller sets arranged after the first shaping roller sets along the outer circumference of the body and in a direction in which the wire moves, each second shaping roller set comprising an upper roller and a lower roller and a shaping portion, into which the wire is inserted to be processed again, between the upper roller and the lower roller, wherein wires processed by the first and second shaping roller sets while passing therethrough are stranded by the rotating body. The apparatus can significantly improve a wire processing rate while reducing a defect rate.

6 Claims, 5 Drawing Sheets

APPARATUS FOR MANUFACTURING TRAPEZOIDAL WIRE USING TWO-SET SHAPING ROLLERS

This application claims the priority of Korean Patent Application No. 10-2006-10570, filed on Feb. 3, 2006, in the Korean Intellectual Property Office, the disclosure of which is incorporated herein in its entirety by reference.

BACKGROUND OF THE INVENTION

1. Field of the Invention

The present invention relates to an apparatus for manufacturing a trapezoidal wire using two-set shaping rollers, and more particularly, to an apparatus for manufacturing a trapezoidal wire using two-set shaping rollers, the apparatus capable of improving an overall reduction rate and reducing a defect rate even at high working speed by using the two-set shaping rollers.

2. Description of the Related Art

A method of manufacturing products using trapezoidal wires includes a method of manufacturing a trapezoidal wire using a separate wire drawing machine and stranding the trapezoidal wire using a stranding machine and a method of manufacturing a trapezoidal wire using a shaping roller in a separate shaping process and stranding the trapezoidal wire using a stranding machine. However, a slow manufacturing speed is a problem for such methods.

U.S. Pat. No. 5,074,140 discloses an apparatus for manufacturing a trapezoidal wire. The apparatus simultaneously shapes and strands a wire using a plurality of shaping roller sets, thereby increasing the manufacturing speed. FIG. 1 illustrates a body 200 of a conventional apparatus for manufacturing a trapezoidal wire, the body 200 having a plurality of shaping roller sets 110, 120, 130, 140, 150, 160, 170, 180 and 190.

Referring to FIG. 1, the shaping roller sets 110, 120, 130, 140, 150, 160, 170, 180 and 190 are disposed along the body 200, and each of the shaping roller sets 110, 120, 130, 140, 150, 160, 170, 180 and 190 includes an upper shaping roller 112 and a lower shaping roller 114. A round wire is inserted between the upper shaping roller 112 and the lower shaping roller 114 of each of the shaping roller sets 110, 120, 130, 140, 150, 160, 170, 180 and 190. Then, each of the shaping roller sets 110, 120, 130, 140, 150, 160, 170, 180 and 190 shapes the round wire into a trapezoidal wire while the body 200 rotates about a rotation axis 201. The trapezoidal wire manufactured by each of the shaping roller sets 110, 120, 130, 140, 150, 160, 170, 180 and 190 is stranded by the rotating body 200.

While the plurality of shaping roller sets 110, 120, 130, 140, 150, 160, 170, 180 and 190 are installed in the body 200 of the conventional apparatus for manufacturing a trapezoidal wire, only one shaping roller set, that is, one-set shaping rollers, is used to shape a wire into a trapezoidal wire. Shaping and stranding a wire using one-set shaping rollers is accompanied by the problem of a wire inserted between the upper and lower shaping rollers 112 and 114 being cut. Such a problem occurs when a shaping speed increases. In other words, when the shaping speed increases, the flow of metal of the wire becomes rapid. In this state, stress working on the wire easily becomes greater than the yield stress of a material of the wire. Consequently, the wire inserted between the upper and lower shaping rollers 112 and 114 is cut.

In addition, the metal flow of the wire between the upper and lower shaping rollers 112 and 114 is not smooth at fast shaping speed. Therefore, a reduction rate, which is a ratio of a cross section of the wire before being shaped to a cross section of the wire after being shaped, is increased. Further, since the wire cannot contact the entire inner surfaces of a shaping portion formed between the upper and lower shaping rollers 112 and 114, a conversion diameter, that is, a value obtained after a cross section of a trapezoidal wire manufactured by the upper and lower shaping rollers 112 and 114 is calculated using a diameter of the round wire, is reduced. Therefore, a wire with a desired cross section cannot be manufactured.

When a wire is inserted between one-set shaping rollers, the wire and the one-set shaping rollers may not be aligned properly. In addition, when the shaping speed of the trapezoidal wire is fast, a side of the inserted wire may be pressed. In this case, a portion of the inserted wire protrudes from the one-set shaping rollers, which is called a lateral flushing phenomenon.

SUMMARY OF THE INVENTION

The present invention provides an apparatus which can excellently strand a wire by preventing the cutting of the wire or the lateral flushing of a processed cross section of the wire even at high shaping speed.

According to an aspect of the present invention, there is provided an apparatus for manufacturing a trapezoidal wire, the apparatus including: a body rotating about a central axis at a predetermined speed; a plurality of first shaping roller sets installed along an outer circumference of the body, each first shaping roller set comprising an upper roller and a lower roller and a shaping portion, into which a wire is inserted to be processed, between the upper roller and the lower roller; and a plurality of second shaping roller sets arranged after the first shaping roller sets along the outer circumference of the body and in a direction in which the wire moves, each second shaping roller set comprising an upper roller and a lower roller and a shaping portion, into which the wire is inserted to be processed again, between the upper roller and the lower roller, wherein wires processed by the first and second shaping roller sets while passing therethrough are stranded by the rotating body.

The apparatus may further include a support member having both ends respectively connected to each of the first shaping roller sets and each of the second shaping roller sets to maintain a gap and alignment between the first and second shaping roller sets.

The apparatus may further include a guide unit installed on a side of each of the first shaping roller sets and guiding the wire to be inserted into the shaping portion of each of the first shaping roller sets.

The guide unit may include: a fixed bracket installed on the side of each of the first shaping roller sets; a fixed member fixed to the fixed bracket; and a wire guide member installed at an end portion of the fixed member and guiding the wire to be inserted into the shaping portion of each of the first shaping roller sets.

A unit reduction rate of the first shaping roller sets may be greater than that of the second shaping roller sets.

The unit reduction rate of the first shaping roller sets may be 60-70% of an overall reduction rate and the unit reduction rate of the second shaping roller sets may be 30-40% of the overall reduction rate.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, an apparatus for manufacturing a trapezoidal wire using two-set shaping rollers will be described more fully with reference to the accompanying drawings, in which exemplary embodiments of the invention are shown.

Figure 1:
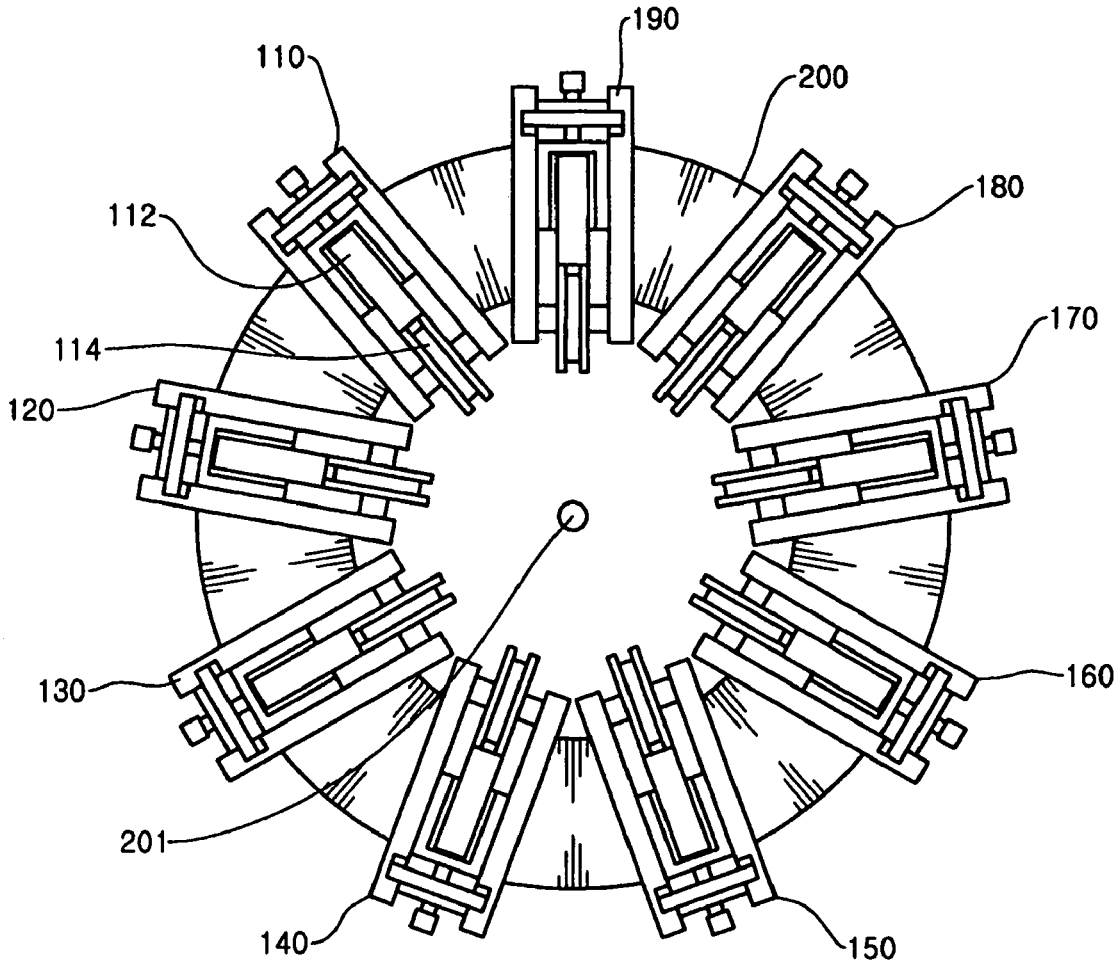
FIG. 1 (PRIOR ART)
FIG. 1 is a front view of a conventional strander.
Figure 2:
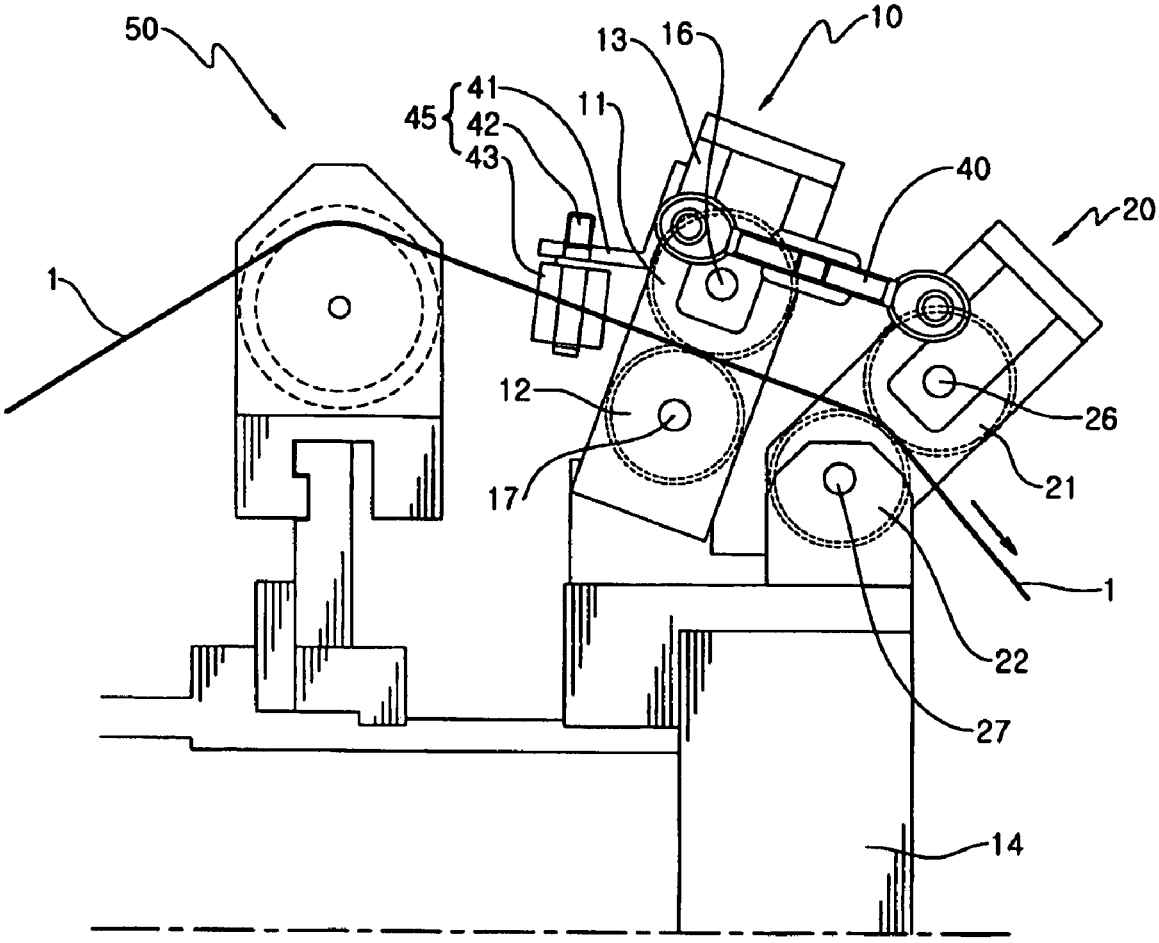
FIG. 2 is a schematic lateral view of an apparatus for manufacturing a trapezoidal wire using two-set shaping rollers according to an embodiment of the present invention.

FIG. 2 is a schematic lateral view of an apparatus for manufacturing a trapezoidal wire using two-set shaping rollers according to an embodiment of the present invention.

Referring to FIG. 2, a wire 1 is supplied by a wire feeder (not shown) and passes through a bobbin 50 and a wire guide member 43. Then, the wire 1 is inserted into a first shaping roller set 10 and then to a second shaping roller 20. There, the wire 1 is stranded.

The first shaping roller set 10 includes an upper roller 11 which is rotatable about a central axis 16 and a lower roller 12 which contacts the upper roller 11 and is rotatable about a central axis 17. The upper roller 11 and the lower roller 12 rotate in opposite directions with respect to a direction in which the wire 1 is transferred. In FIG. 2, for example, the upper roller 11 rotates in a counter clockwise direction while the lower roller 12 rotates in a clockwise direction. While rotating in opposite directions, the upper roller 11 and the lower roller 12 shape the wire 1. Similarly, the second shaping roller set 20 includes upper and lower rollers 21 and 22 which are rotatable about central axes 26 and 27, respectively. While rotating, the upper and second rollers 21 and 22 shape the wire 1 again.

As illustrated in FIG. 2, the first and second shaping roller sets 10 and 20 are arranged along an outer circumference of a body 14 in the direction in which the wire 1 is transferred. Although the first and second shaping roller sets 10 and 20 are illustrated in FIG. 2, the present invention is not limited thereto. A plurality of pairs of the shaping roller sets may be installed along the outer circumference of the body 13. The body 14 rotates at a predetermined speed. Wires shaped by the first and second shaping roller sets 10 and 20 while passing therethrough are stranded by the rotation of the body 14. In addition, the first shaping roller set 10 and the second shaping roller set 20 are supported by a support member 40 interposed therebetween such that the alignment and gap between the first shaping roller set 10 and the second shaping roller set 20 can be maintained.

A guide unit 45, which guides the moving wire 1 to be precisely inserted between the upper and lower rollers 11 and 12 of the first shaping roller set 10, is installed on a side of a housing 13 of the first shaping roller set 10. The guide unit 45 includes a fixed bracket 41, a fixed member 42, and a wire guide member 43. The fixed bracket 41 is installed on the side of the housing 13 of the first shaping roller set 10, and the fixed member 42 is fixed to the fixed bracket 41. The wire guide member 43 is installed at an end portion of the fixed member 42 and guides the wire 1 to be inserted between the upper and lower rollers 11 and 12 of the first shaping roller set 10. Due to the guide unit 45, the moving wire 1 can be precisely inserted between the upper and lower rollers 11 and 12 of the first shaping roller set 10 without deviating from its path.

The wire 1 shaped by the upper and lower rollers 11 and 12 of the first shaping roller set 10 as described above is shaped again by the upper and lower rollers 21 and 22 of the second shaping roller set 20. A process of shaping the wire 1 using the first and second shaping roller sets 10 and 20 will now be described in more detail.

Figure 3:
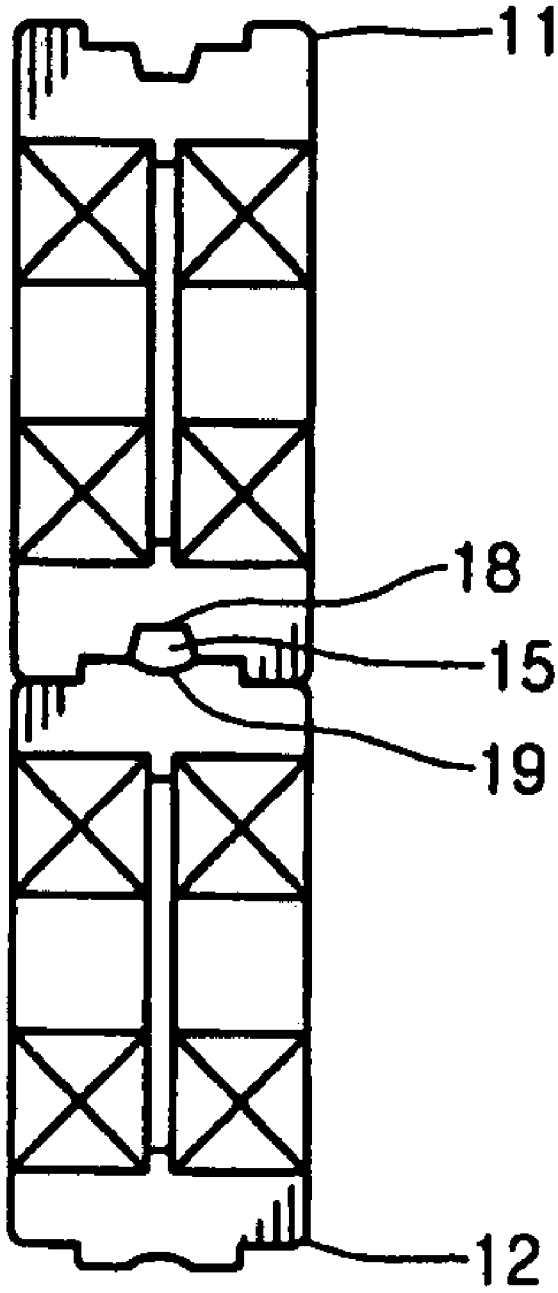
FIG. 3 is a front view illustrating the disposition of upper and lower rollers of a first shaping roller set of FIG. 2.

FIG. 3 is a front view illustrating the disposition of the upper and lower rollers 11 and 12 of the first shaping roller set 10.

Referring to FIG. 3, the first shaping roller set 10 of FIG. 2 includes the upper roller 11 and the lower roller 12, and shaping grooves 18 and 19 for shaping the wire 1 are formed along outer circumferences of the upper and lower rollers 11 and 12, respectively. The size or inclination angle of the shaping grooves 18 and 19 may vary. As illustrated in FIG. 3, the upper roller 11 is disposed on and contacts the lower roller 12, and a shaping portion 15 through which the wire 1 is passed to be processed is formed between the shaping grooves 18 and 19 of the upper and lower rollers 11 and 12, respectively, which are in contact with each other.

Figure 4:
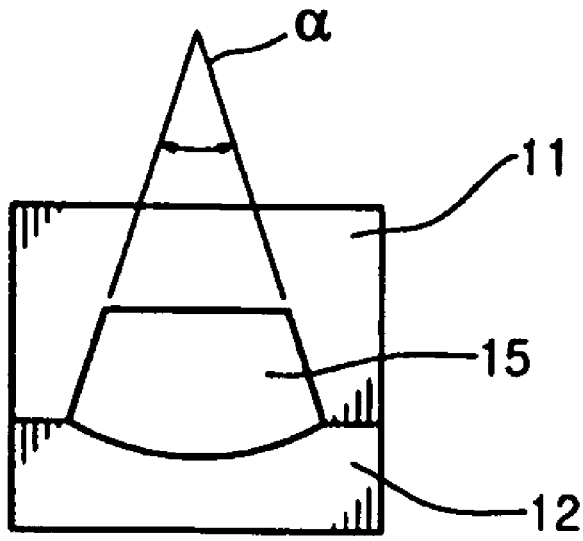
FIG. 4 is an enlarged front view of a shaping portion between the upper and lower rollers of the first shaping roller set of FIG. 2.
Figure 5:
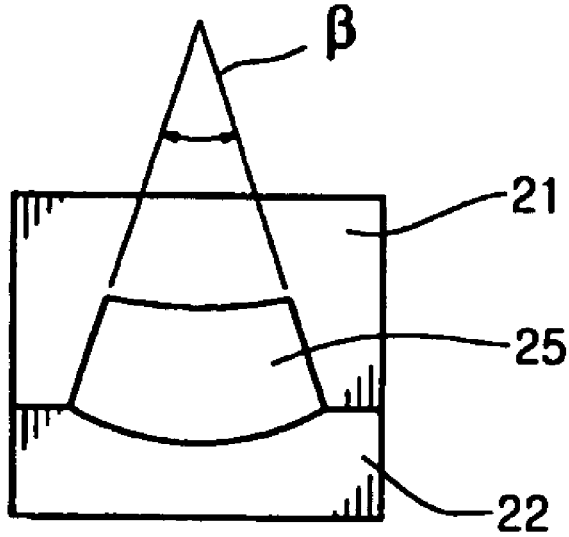
FIG. 5 is an enlarged front view of a shaping portion between upper and lower rollers of a second shaping roller set of FIG. 2.

FIG. 4 is an enlarged front view of the shaping portion 15 between the upper and lower rollers 11 and 12 of the first shaping roller set 10. FIG. 5 is an enlarged front view of a shaping portion 25 between the upper and lower rollers 21 and 22 of the second shaping roller set 20.

When the wire 1 is shaped by the first and second shaping roller sets 10 and 20 while passing therethrough, a ratio of a cross section of the wire 1 before being inserted into each of the first and second shaping roller sets 10 and 20 to the cross section of the wire 1 after being inserted into each of the first and second shaping roller sets 10 and 20 is defined as a unit reduction rate in the present invention.

To strand the wire 1 at a desired reduction rate according to an embodiment of the present invention, a unit reduction rate of the first shaping roller set 10 and that of the second shaping roller set 20 are distributed at a distribution rate according to the present invention.

An angle $\alpha$ formed at a point where virtual lines extending from both sides of the shaping portion 15 of the first shaping roller set 10 meet is greater than an angle $\beta$ formed at a point where virtual lines extending from both sides of the shaping portion 25 of the second shaping roller set 20 meet.

The unit reduction rates of the first shaping roller set 10 is greater than those of the second shaping roller set 20.

In addition, the unit reduction rate of the first shaping roller set 10 is 60-70% of an overall reduction rate, and the unit reduction rate of the second shaping roller set 20 is 30-40% of the overall reduction rate.

Cross sections of shaping portions 15, 25 of the first and second shaping roller sets 10 and 20 may have identical or different shapes.

As described above, when a trapezoidal wire is formed by conventional one-set shaping rollers after a wire is inserted therebetween, a lateral flushing phenomenon occurs, and the inserted wire is pressed by a side of an upper roller of the conventional one-set shaping rollers 5. As a result, a finished wire has defects, the wire is cut when the stranding speed of the wire is increased, and the quality of the stranded wire deteriorates. However, when two-set shaping rollers are used according to the present invention, metal consisting of the wire can contact the entire inner surfaces of the shaping rollers 11, 12, 21, and 22 due to a superior metal flow, and deformation and lateral flushing of the wire after the shaping process can be prevented. Further, when the conventional one-set shaping roller are used, a wire may be cut or deformed at a maximum stranding speed of 10 mpm. However, when the two-set shaping rollers according to the present invention are used, a satisfactory stranding operation can be performed at a stranding speed of 20 mpm. In addition, since the cross section of a wire produced by the two-set shaping rollers is better than that of a wire produced by the conventional one-set shaping roller, a converted diameter of the wire produced by the two-set shaping rollers is greater than that of the wire produced by the conventional one-set shaping roller. Further, when the two-set shaping rollers are used, the stranding speed can be increased and the quality of the stranded wire can be improved, compared with when the conventional one-set shaping rollers 5 are used.

For example, when the trapezoidal wire 1 is manufactured by the conventional one-set shaping roller using the 5 mm-round wire 1 with a reduction rate of 16.37%, a converted diameter, that is, a value obtained after the cross section of the trapezoidal wire 1 manufactured by the one-set shaping rollers is calculated using a diameter of the round wire 1, is 4.59 mm. However, when the trapezoidal wire 1 is manufactured by the two-set shaping rollers according to the present invention with a total reduction rate of 15.63%, if the unit reduction rate of the first shaping roller set 10 is 9.53% and that of the second shaping roller set 20 is 6.1%, the converted diameters of the first and second shaping roller sets 10 and 20 are 4.78 mm and 4.61 mm, respectively. When the unit reduction rates of the second shaping rollers 21 and 22 are 6.1%, the converted diameters of the second shaping rollers 21 and 22 are 4.61 mm. Therefore, it can be understood that the converted diameter of the two-set shaping rollers according to the present invention is larger than that of the conventional one-set shaping roller.

Figure 6:
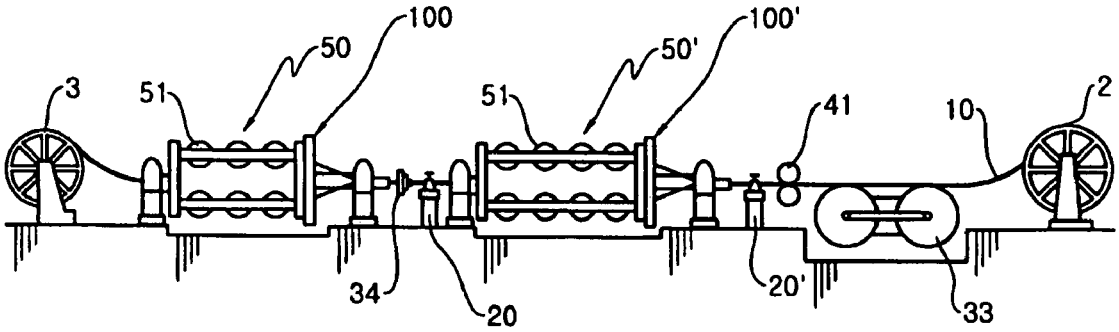
FIG. 6 is a schematic diagram illustrating the configuration of a strander for manufacturing a trapezoidal wire using two-set shaping rollers according to an embodiment of the present invention.

FIG. 6 is a schematic diagram illustrating the configuration of a strander for manufacturing a trapezoidal wire using two-set shaping rollers according to an embodiment of the present invention.

The strander includes a wire feeder 3, a first stranding body 50, first two-set shaping rollers 100, a preformer 34, a first collection dies 20, a second stranding body 50', second two-set shaping rollers 100', a second collection dies 20', a measurer 41, a capstan 33, and a winder 2. A bobbin 51 around which wires to be stranded are wound is mounted on the first stranding body 50. While rotating, the first stranding body 50 strands the wires.

To tightly strand the wires, the preformer 34 performs plastic deformation before the wires are collected. When both of the wires in the first and second stranding bodies 50, 50' are trapezoidal wires, the first preformer 34 may be omitted.

The first two-set shaping rollers 100 includes a first shaping roller set 10 and a second shaping roller set 20 as a single set and shapes the round wire 1 into a trapezoidal wire. The first collection dies 20 collects a plurality of strands of wire and produces a finished cable. The first collection dies 20 can be made from MC-nylon.

As in the first stranding body 50, the bobbin 51 around which wires to be stranded are wound is mounted on the second stranding body 50'. While rotating, the second stranding body 50' strands the wires.

The second two-set shaping rollers 100' includes a first shaping roller set 10 and a second shaping roller set 20 as a single set and shapes the round wire 1 into a trapezoidal wire. When the second wire is round, the first two-set shaping rollers 100 may be omitted.

Like the first collection dies 20, the second collection dies 20' collects a plurality of strands of wire and produces a finished cable. The second collection dies 20 also can be made from MC-nylon.

The measurer 41 measures the lengths of the stranded and processed wires or electric wires and is formed of a wheel or a belt. The capstan 33 pulls the collected and processed wires or electric wires with a predetermined tension. The capstan 33 is twisted at a predetermined angle to prevent the rotation of the processed wires.

The winder 2 winds the stranded wires and includes a traverse device in order to achieve winding alignment.

One or two first and second stranding bodies 50 and 50' may be used according to products and types. The stranding bodies 50 and 50' is selected according to types of wires to be manufactured. That is, the structure of a strander may be changed to include one stranding body or two stranding bodies.

When the round wires 1 are stranded, they maintain a line-contact state. The preformer 34 is required to prevent the round wires 1 from being untwisted due to elasticity between them and to tighten the twisted state. However, when the trapezoidal wires 1 are manufactured, since the wires 1 maintain a surface contact state, they are not untwisted due to elasticity between them. Therefore, the preformer 34 can be omitted.

The two-set shaping rollers 100 are used to produce a trapezoidal wire. Therefore, if a first layer or a second layer of the wire 1 to be manufactured is round, the two-set shaping rollers 100 are omitted. For example, the first two-set shaping rollers 100 or the second two-set shaping rollers 100' can be partially omitted.

The two-set shaping rollers 100 according to the present invention can be used to strand the wire 1 into a trapezoidal wire. The two-set shaping rollers 100 can be applied to apparatuses for manufacturing a wire of a trapezoidal or any desired shape. The two-set shaping rollers 100 can be applied to high capacity power cables and overhead cables.

In addition, the method of manufacturing the trapezoidal wire 1 using the two-set shaping rollers 100 is significantly simpler than the method of manufacturing a trapezoidal wire in a separate process.

Since the strander according to the present invention has the two-set shaping rollers 100, a metal flow of the wires in the upper and lower shaping rollers 11, 12, 21 and 22 of the first and second roller sets 10 and 12 is better than the strander having the conventional one-set shaping roller 5. Also, stress working on the wire 1 is reduced, thereby preventing the wire 1 from being cut.

As described above, the present invention provides an apparatus for manufacturing a trapezoidal wire using two-set shaping rollers. Therefore, even when a wire is inserted and stranded at fast stranding speed, the lateral flushing phenomenon does not occur, and the cutting of the wire can be prevented. In addition, the quality of the cross section of the processed wire can be enhanced.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An apparatus for manufacturing a trapezoidal wire, the apparatus comprising:

a body rotating about a central axis at a predetermined speed;

a plurality of first shaping roller sets installed along an outer circumference of the body, each first shaping roller set comprising an upper roller and a lower roller and a shaping portion, into which a wire is inserted to be processed, between the upper roller and the lower roller; and a plurality of second shaping roller sets arranged after the first shaping roller sets along the outer circumference of the body and in a direction in which the wire moves, each second shaping roller set comprising an upper roller and a lower roller and a shaping portion, into which the wire is inserted to be processed again, between the upper roller and the lower roller, wherein wires processed by the first and second shaping roller sets while passing therethrough are stranded by the rotating body.

2. The apparatus of claim 1, further comprising a support member having both ends respectively connected to each of the first shaping roller sets and each of the second shaping roller sets to maintain a gap and alignment between the first and second shaping roller sets.

3. The apparatus of claim 2, further comprising a guide unit installed on a side of each of the first shaping roller sets and guiding the wire to be inserted into the shaping portion of each of the first shaping roller sets.

4. The apparatus of claim 3, wherein the guide unit comprises:

a fixed bracket installed on the side of each of the first shaping roller sets;

a fixed member fixed to the fixed bracket; and a wire guide member installed at an end portion of the fixed member and guiding the wire to be inserted into the shaping portion of each of the first shaping roller sets.

5. The apparatus of any one of claim 1 through 4, wherein a unit reduction rate of the first shaping roller sets is greater than that of the second shaping roller sets.

6. The apparatus of claim 5, wherein the unit reduction rate of the first shaping roller sets is 60-70% of an overall reduction rate and the unit reduction rate of the second shaping roller sets is 30-40% of the overall reduction rate.

* * * * *